United States Patent [19]

Shie, III

[11] 3,986,304

[45] Oct. 19, 1976

[54] SHARPENER FOR COMMODITY SLICING MACHINE

[75] Inventor: Herman J. Shie, III, Sidney, Ohio

[73] Assignee: Hobart Corporation, Troy, Ohio

[22] Filed: Dec. 2, 1975

[21] Appl. No.: 632,290

[52] U.S. Cl. ..... 51/248; 83/174.1

[51] Int. Cl.[2] ..... B24B 3/46

[58] Field of Search ..... 83/174.1; 51/246, 247, 51/248, 250

[56] References Cited

UNITED STATES PATENTS

| | | | |
|---|---|---|---|
| 1,939,740 | 12/1933 | Van Berkel | 51/248 |
| 2,052,367 | 8/1936 | Folk | 51/248 |
| 2,614,373 | 10/1952 | Van Duyn | 51/248 |
| 3,182,700 | 5/1965 | Engi | 51/248 X |

FOREIGN PATENTS OR APPLICATIONS

| | | | |
|---|---|---|---|
| 649,575 | 1/1951 | United Kingdom | 51/248 |

*Primary Examiner*—Al Lawrence Smith
*Assistant Examiner*—J. C. Peters

[57] ABSTRACT

The guard cover for a commodity slicing machine sharpener extends over and protects the otherwise exposed knife edge at the knife sharpening area. The guard protects the knife edge at all times regardless of whether the sharpener is in the sharpening position, storage position, or is being moved between these positions. The sharpener employs a non-rotatable honing stone which seeks proper honing relationship with the knife upon coming into contact therewith. A latch holds the sharpener when in the sharpening position and prevents it from being returned to the storage position until released. The latch release is position dependent so that the operator's hand and fingers should be in a certain predetermined position on the sharpener housing, away from the knife edge, to operate the latch release.

5 Claims, 12 Drawing Figures

SHARPENER FOR COMMODITY SLICING MACHINE

CROSS REFERENCE TO RELATED APPLICATION

Reference is made to U.S. application Ser. No. 502,799, filed Sept. 3, 1974, now U.S. Pat. No. 3,958,478, issue date May 25, 1976, assigned to the assignee of the present invention.

BACKGROUND OF THE INVENTION

This invention relates to commodity slicing machines, and more particularly to a knife sharpener, associated guard cover, mounting means, and position dependent latch for quick and convenient sharpening of the slicing machine cutting knife.

Sharpening devices for commodity slicing machines are well known and have been standard slicing machine accessories for many years. Examples include U.S. Pat. Nos. 1,263,414, 1,821,280, 1,939,740, 2,486,810 and 2,614,373. The extremely keen knife edge regularly maintained by such sharpeners can present quite a safety hazard. It is therefore customary to equip slicing machines with a variety of safety features to guard and discourage the machine operator from accidental contact with the edge of the slicing knife. This is particularly important when the knife is rotating, as during slicing and sharpening operations. Thus, the exposed front and back surfaces of the circular cutting knife are normally covered with guard plates and/or shields, and those areas of the knife edge which are outside the active cutting area are protected and surrounded with a knife edge guard.

In order to sharpen the knife, it is of course necessary to bring the sharpener into contact with it. Usually a portion of the knife edge is exposed and the sharpener is brought into an active sharpening position at the exposed area. Some sharpeners include provisions for covering the exposed knife edge once the sharpener is in the sharpening position, and some do not. Some sharpeners provide rather direct mechanical linkages for conveniently shifting the sharpener between the storage and sharpening positions, while others require the sharpener to be entirely detached from the machine and then reattached at each position.

In all such cases, however, the knife edge is exposed and easily accessible to the operator at some time or another. The prior art has yet to provide a sharpener which incorporates the desirable features of an easy, single action movement from a storage position to a sharpening position and back again without unnecessarily exposing the knife edge, which reduces the likelihood of exposure of the operator's hands and fingers to the knife edge, which is easily removable from the slicing machine for cleaning, which is well protected in the storage position from scraps and other residues, and which is uncomplicated, effective, durable and economical in construction.

SUMMARY OF THE INVENTION

Briefly, the present invention provides a knife sharpening means which is mounted for movement between a storage position slightly removed from the knife edge and a sharpening position in which knife dressing members, such as sharpening and honing stones, straddle the knife edge. The movement between the storage and sharpening positions is a simple "up and over" movement guided by pairs of channels and by pins engaged therein.

The knife cutting edge may be exposed in two areas: an active cutting area in which the food or other commodities are sliced, and a sharpening area for receiving the knife sharpener. The remaining parts or areas of the knife cutting edge are essentially inactive and are surrounded and protected by the knife edge guard.

In order to protect the knife edge in the sharpening area, a guard cover on the knife sharpening means has a special guarding section which extends substantially over and protects the otherwise exposed cutting edge in the sharpening area. The guarding section covers and protects the cutting edge at all times when the sharpener is mounted on the slicing machine, regardless of whether the sharpener is in the sharpening position, the storage position, or somewhere in between.

Thus the guarding section has a first portion which is located on one side of the mount for the dressing members and which straddles the cutting edge in the sharpening position to limit access to the knife edge. A second portion of the guarding section is located adjacent the first portion on the same side of the dressing member mount, and similarly straddles the cutting edge when the sharpener is in the storage position. The second portion is a cantilivered extension of the first portion and cooperates therewith to cover and protect the exposed knife edge in the sharpening area even while the sharpener is being moved between the storage and sharpening positions. The guarding section thus protects the otherwise exposed knife cutting edge at all time in and between the sharpening and storage positions.

In order to improve sanitation, the sharpener is substantially enclosed and isolated from the exterior of the commodity slicing machine when in the storage position. A sanitary wall separates the first and second guarding section portions in order to complete the isolation of the knife sharpener in the storage position. This prevents residues from being thrown from the knife onto the knife sharpener.

The single action movement of the sharpener is facilitated by two pairs of channels, one pair being shaped somewhat like an inverted U, and both pairs being supported on the slicing machine near the knife sharpening area. The knife sharpener itself is supported and guided within these channels by four pins which are captured therewithin. Movement of the sharpener thus involves simply grasping the sharpener housing with one hand, lifting the sharpener along one side of the U channels until the upper pair of pins reaches the top, moving the upper pins across the connecting horizontal portions of each channel, and then back down the remaining sides of each channel. The sharpener housing is shaped to form a convenient hand-hold to facilitate grasping and moving the sharpener, as described.

When the sharpener is moved into the sharpening position, a position dependent latch is engaged to hold it there and to discourage the operator from grasping the sharpener housing in a manner which might endanger his fingers. More particularly, the latch release is located rather inaccessibly on the underside of the sharpener housing opposite the slicer blade. Although somewhat inaccessible, the release can easily be reached and operated if the sharpener housing is grasped by one hand with the fingers wrapped around underneath the housing to contact and press the release. This is the preferred hand position since it reduces the risk of injury from accidental contact with the slicer blade. Thus, since the hand should be in this position to operate the latch release, it is difficult for the fingers to be simultaneously on the other side of the sharpener near the blade. The latch is therefore a position dependent latch which enhances operator safety.

The present invention thus provides both convenience and improved safety. The convenience results from the ease, simplicity, and effectiveness of the sharpener in use; the safety from the guarding section and latch which protect the knife edge in the sharpening area at all times and cooperate to reduce substantially the chances of accidental contact therewith by the machine operator.

Although the sharpener is attached to the commodity slicing machine, it may easily be removed for cleaning. To this end a pair of the pins which are captured within the guide channels are spring loaded for retracting movement into the knife sharpener mount and thus out of the channels. This partially releases the sharpener and enables the remaining pins to be slid quickly and easily out of their channels.

The honing stone is non-rotatable and is pivoted to facilitate proper dressing of the knife edge. It is initially presented to the knife cutting edge at an angle direct somewhat thereacross, and then as the stone is removed toward the cutting edge it is pivoted to an angle substantially parallel thereto. The honing stone thus automatically seeks the best orientation with respect to the knife edge.

It is therefore an object of the present invention to provide a knife sharpener for a commodity slicing machine; a guard cover for such a sharpener; guarding sections on the guard cover which at all times extend substantially over and protect the knife cutting edge in the sharpening area; a sharpener which is substantially enclosed and isolated from the exterior of the commodity slicing machine when in a retracted storage position; which has an easy single action movement from the retracted storage position to the sharpening position straddling the knife edge; which may be removed easily from the slicing machine for cleaning; which includes a position dependent latch which encourages the operator to grasp the sharpener housing with his fingers away from the knife edge; in which the guards for the inactive areas of the slicing blade need not be removed or shifted in order to sharpen the blade, and the slicing guage plate may similarly remain closed; in which the honing stone automatically seeks the proper dressing angle; and to accomplish the above objects and purposes in an uncomplicated, inexpensive, safe, and durable configuration readily suited to a wide variety of commodity slicing machines.

Other objects and advantages of the invention will be apparent from the following description, the accompanying drawings and the appended claims.

BRIEF DESCRIPTION OF THE DRAWINGS

FIG. 9 shows the sharpening stone moved into engagement with the knife;

DESCRIPTION OF THE PREFERRED EMBODIMENT

Figure 1:
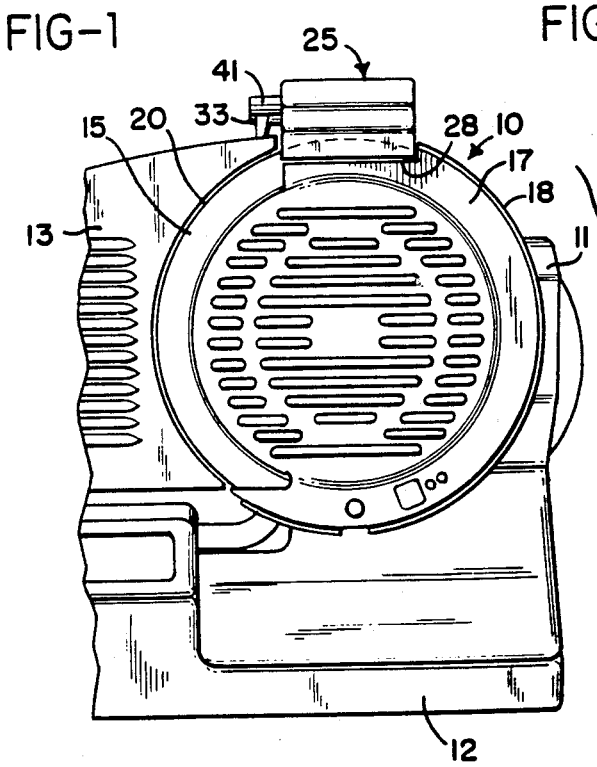
FIG. 1 is a side view of a portion of a commodity slicing machine incorporating the sharpener, associated guard cover, and latch of the present invention.

FIG. 1 illustrates a conventional commodity slicing machine 10 having a housing 11, a base 12, an adjustable gauge plate 13, a circular cutting knife 15, a drive means (not shown) for rotating knife 15, a knife guard plate 17 having an edge guard portion 18, and so on.

The area around the edge 20 of knife 15 is divided roughly into three parts; a first part wherein the knife edge 20 is exposed in an active cutting area adjacent guage plate 13, a second part exposing the knife edge in an area adjacent a sharpener 25 constructed according to the present invention, and the remaining part which is protected by edge guard 18 and is an essentially inactive knife area.

Figure 2:
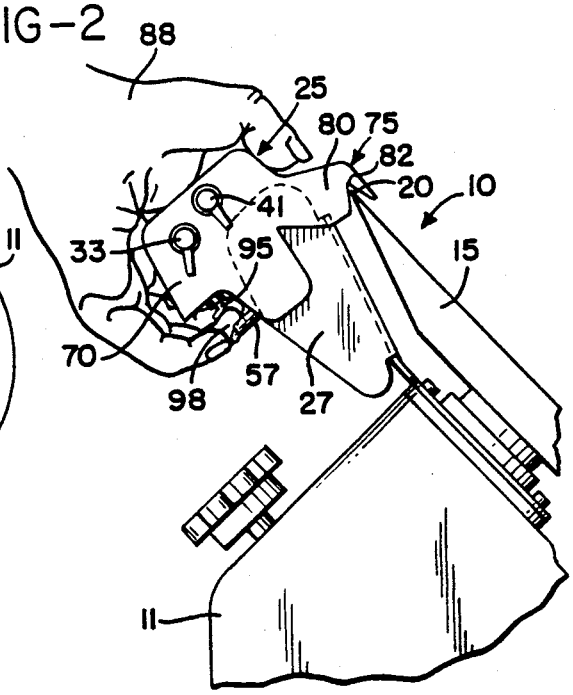
FIG. 2 is an end view of the FIG. 1 sharpener mounted on the slicing machine in the storage position, with the slicing blade cover plate removed for clarity of illustration.
Figure 3:
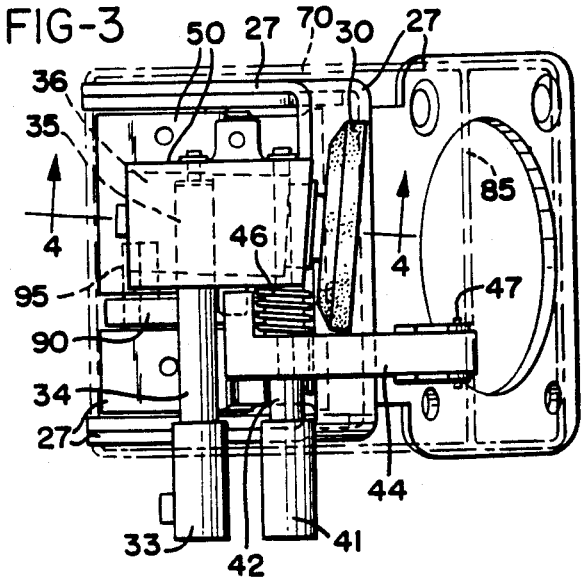
FIG. 3 is a top view of the FIG. 2 sharpener, with the sharpener guard cover shown in phantom.

Sharpener 25 is conveniently mounted near knife 15 on a bracket 27 attached to the machine housing 11. FIGS. 1 and 2 show bracket 27 supporting sharpener 25 on the top side of machine 10 where it is easily reached by the machine operator. A cutout 28 in the knife guard plate 17 and edge guard 18 exposes the knife edge in the sharpening area opposite sharpener 25.

Figure 4:
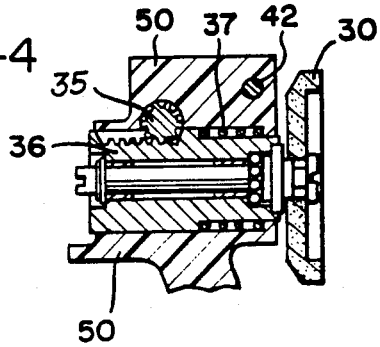
FIG. 4 is a section on line 4—4 in FIG. 3.

Sharpener 25 includes dressing members 30 and 31 which are engageable with opposite sides of knife 15 when the sharpener is positioned at its sharpening position (FIG. 9) for sharpening the knife edge 20. Dressing member 30 is a rotatable sharpening stone which may be displaced toward the knife by rotating a first handle 33 which turns a first shaft 34 to rotate a pinion 35 thereon (FIG. 4) which drives a rack 36 to urge sharpening stone 30 against a return spring 37 and toward the knife edge 20.

After the edge is sharpened by stone 30, it is honed by dressing member 31. Member 31 is a honing stone which is moved toward the knife edge 20 by turning a second handle 41 to rotate a second shaft 42 on which a honing stone arm 44 is affixed. Arm 44 is normally urged against a stop 45 by a return spring 46.

Figure 10:
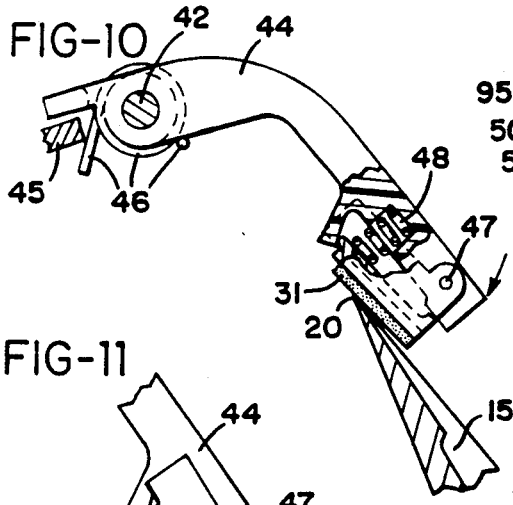
FIGS. 10 and 11 show the honing stone engaging the knife and pivoting to the proper honing angle.
Figure 11:
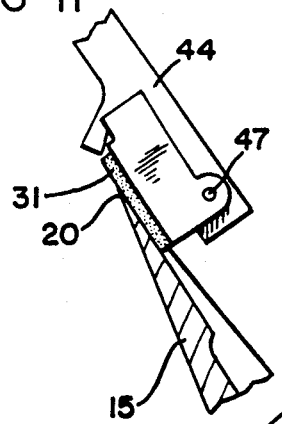

Honing stone 31 is normally supported on arm 44 at an angle which positions stone 31 at an angle directed partially across the knife cutting edge 20 (FIG. 10), when handle 41 is rotated to bring stone 31 toward knife edge 20. Stone 31 is non-rotatable, but is free to pivot on a pivot 47 against a return spring 48 so that as arm 44 moves stone 31 toward knife 15, stone 31 engages the knife edge and pivots to an angle substantially parallel thereto (FIG. 11). The honing stone thus automatically seeks the proper dressing angle as it is moved towards the knife cutting edge 20 while it is engaged therewith.

Figure 5:
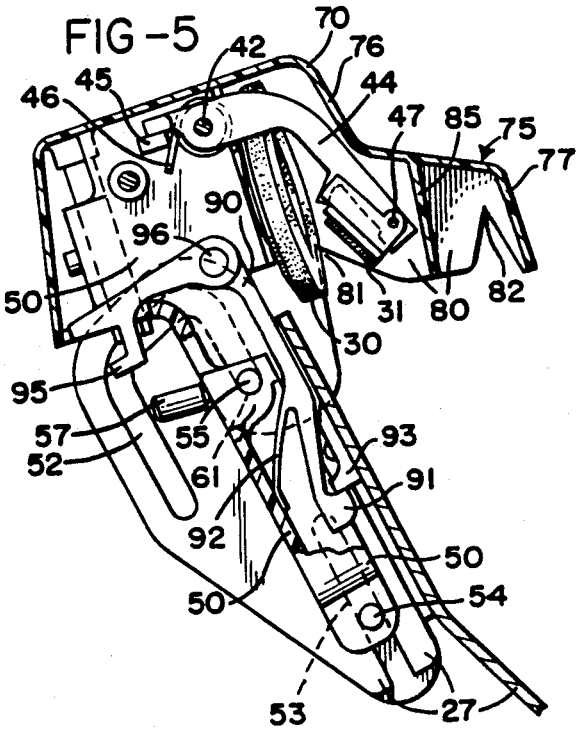
FIG. 5 is an enlarged end view of the FIG. 2 sharpener in the sharpening position, with the stationary sharpener mount and the guard cover shown in section.
Figure 6:
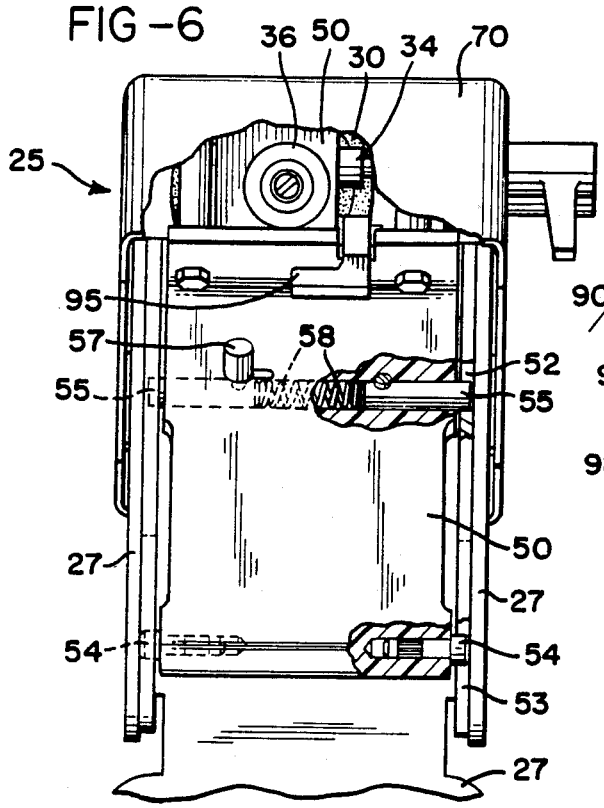
FIG. 6 is a partially broken away and partially sectioned rear view of the sharpener showing the fixed and retractable pins engaged in the channel pairs.
Figure 12:
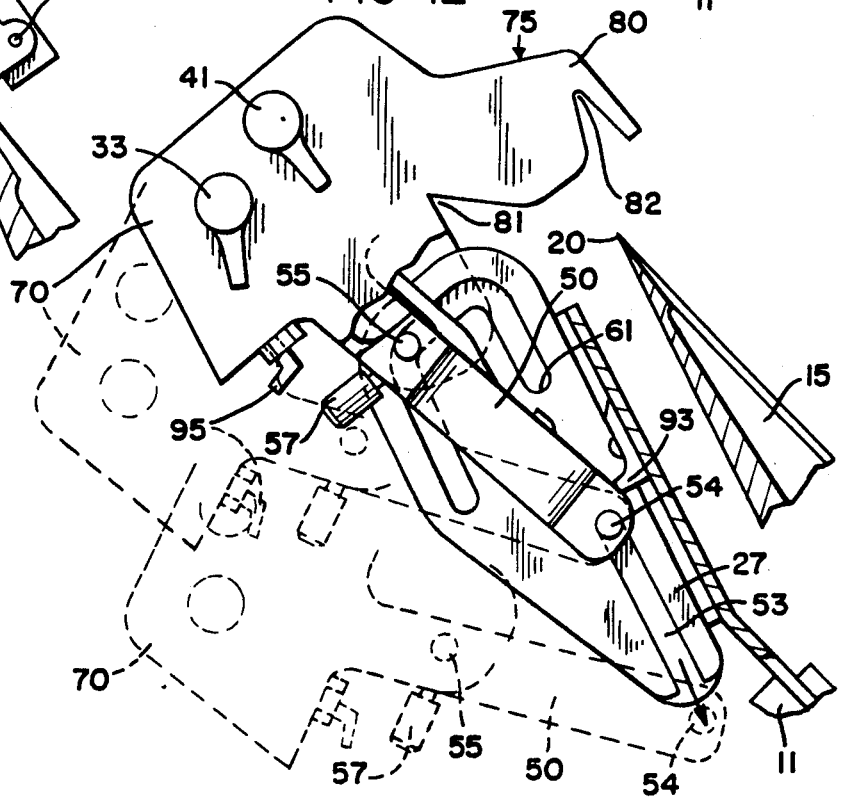
FIG. 12 illustrates removal of the sharpener from the bracket on the slicing machine.

As indicated, sharpener 25 is movable from a retracted storage position (FIGS. 2 and 7) to a sharpening position (FIGS. 5 and 9) and back again. The movable portions of sharpener 25 are carried on a supporting plate member 50 which is movably engaged with bracket 27. In particular, bracket 27 includes a first pair of complementary channels 52 shaped somewhat like an inverted U, and a second pair of open ended channels 53 located beneath channels 52. A pair of fixed pins 54 extend from plate member 50 into channels 53, and a pair of retractable pins 55 extend into channels 52. Normally pins 54 and 55 are captured for movement within their corresponding channels 53 and 52 and thus define the entire path of movement of the sharpener 25 between the sharpening and storage positions. However, when it is desired to remove sharpener 25 from slicing machine 10, as for service or cleaning, a pair of buttons 57 (FIG. 6) may be moved against return springs 58 to retract pins 55 into supporting member 50. Pins 55 may thus be moved relative to sharpener 25 and out of channels 52. This partially releases the sharpener from bracket 27 (FIG. 12) and allows pins 54 to be slid through the open ends of channels 53 to release sharpener 25 for convenient removal from slicing machine 10 (FIG. 12). The sharpener is then reattached by reversing the above steps.

The retracted storage position for sharpener 10 (FIGS. 2 and 7) is defined by the first ends 60 of channels 52. These ends locate pins 55 in a position slightly removed from knife 15 so that the supporting plate member 50 and the other movable portions of sharpener 25 are guided to a retracted storage position removed from the knife edge 20. The opposite or second ends 61 of channels 52 locate the sharpening and honing stones 30 and 31 in a sharpening position straddling knife edge 20 (FIG. 9).

With the above configuration, sharpener 25 is easily moved from the storage position (FIG. 7) to the sharpening position (FIG. 9) by first lifting the sharpener to move pins 55 from the first channel ends 60 and through the adjacent, somewhat vertical legs of channels 52, then transversely through the somewhat horizontal connecting legs of channels 52 (FIG. 8), and finally downwardly through the outer legs of channels 52 to ends 61. The sharpener is returned to the storage position by reversing the above movements. Thus the channel means 52 and 53 guide the knife sharpener 25 and define the entire path of movement between the sharpening and storage positions.

A guard cover 70 is supported on plate 50, and the outer surface of cover 70 is shaped to form a convenient handhold for grasping and moving the sharpener between the storage and sharpening positions, as described above. Cover 70 includes a guarding section 75 located on one side of the plate. Section 75 includes a first portion 76 which substantially straddles the knife cutting edge 20 when sharpener 25 is in the sharpening positon (FIG. 9). A second portion 77 of section 75 is cantilevered from the first portion 76 immediately adjacent thereto and on the same side of plate 50 as first portion 76. Second portion 77 is located to straddle the knife cutting edge 20 when sharpener 25 is in the storage position (FIG. 7).

Figure 8:
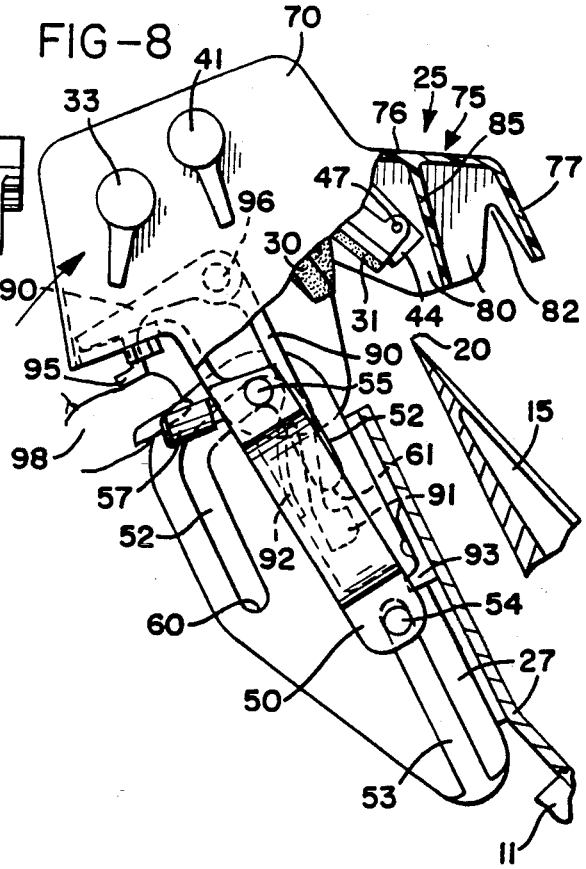
FIGS. 7–9, are sequential views showing movement of the sharpener from the storage to the sharpening positions.
Figure 7:
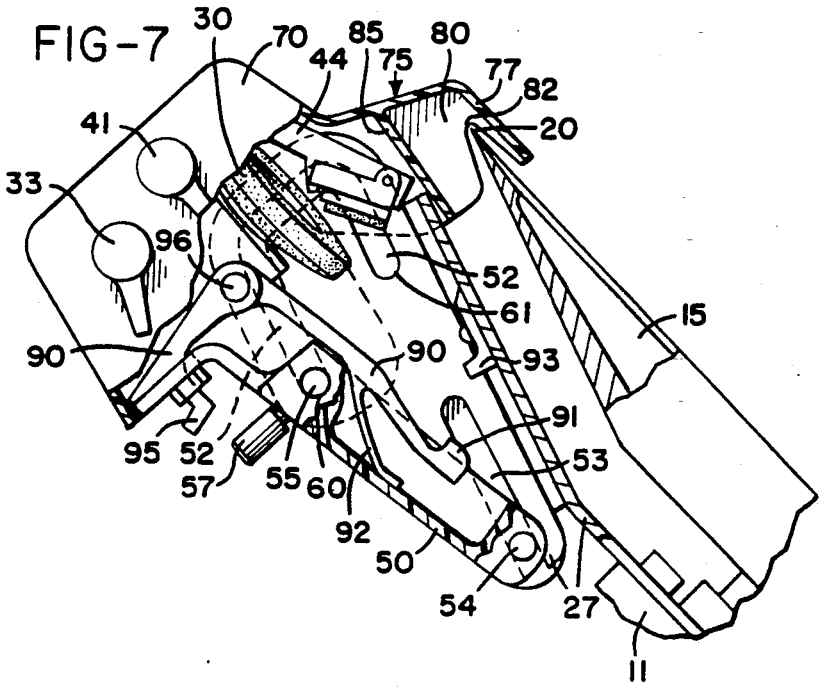
Figure 9:
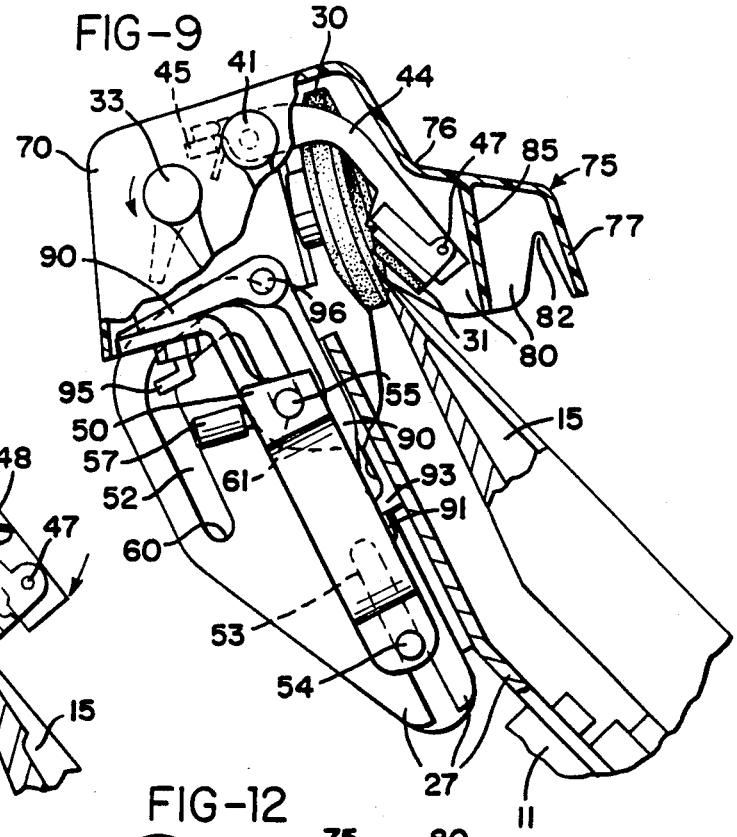

With reference to FIGS. 1, and 7–9, the guarding section 75 of guard cover 70 is arranged to extend substantially over and protect the knife edge 20 in the sharpening area adjacent cutout 28 at all times that sharpener 25 is between, as well as in, the sharpening and storage positions. FIGS. 1 and 7 show the knife edge protected in the storage position, with second portion 77 coinciding closely with cutout 28. FIG. 8 shows the knife edge protected simultaneously by portions 76 and 77 while sharpener 25 is between the sharpening and storage positions. FIG. 9 shows the knife edge protected by first guarding section portion 76 in the sharpening position.

With reference to these same figures, the guarding section 75 also includes end walls 80 having notches 81 and 82 for the first and second portions 76 and 77, respectively. These notches extend across and receive the knife edge 20 therein, so that portions 76 and 77 are able to straddle the knife edge 20 with the knife projecting therewithin in the sharpening and storage positions.

A sanitary wall 85 separates first and second guarding section portions 76 and 77 to help protect the sharpening and honing stones 30 and 31 from commodity residues when sharpener 25 is in the storage position. FIG. 7 shows that supporting plate member 50, guard cover 70, bracket 27 and sanitary wall 85 almost entirely enclose the knife sharpening and honing stones 30 and 31 in the storage position. Thus stones 30 and 31 are isolated from knife 15 and the exterior of commodity slicing machine 10 in the storage position.

When the sharpener 25 is moved into the sharpening position (FIG. 5), the latch hook 91 of a latch 90 engages a keeper 93 to hold the sharpener in this position. Hook 91 is biased toward keeper 93 by an integral resilient spring arm 92 which engages and presses against the supporting member 50. Latch 90 is released by pressing upwardly against a latch release extension 95 on the end of latch 90 opposite hook 91. When release 95 is pressed upwardly, it causes latch 90 to rotate about a pivot 96, which serves as a guide for the movement of latch 90, and this causes hook 91 to move away from keeper 93 toward supporting member 50, and against the bias of spring 92. Latch release 95 is then held in this position until the sharpener is moved upwardly far enough to cause hook 91 to clear keeper 93.

As best illustrated in FIGS. 2 and 8, latch 90 is specifically designed to be position dependent. That is, in normal use the sharpener is moved between the storage and sharpening positions by the operator's left hand 88. Latch 90 is designed to encourage the operator to grasp the sharpener cover 70 in the preferred position illustrated in FIG. 2, so that his left fingers and thumb are well clear of the knife edge 20. To accomplish this, the latch release 95 is positioned on the opposite side of sharpener 25 from the guarding section 75, and beneath the guard cover 70. In this position, the operator's hand must ordinarily wrap around the cover 70 in order to permit one of the operator's left hand fingers 98 to engage and squeeze the latch release 95 so that the sharpener may be returned to its storage position. The latch is thus position dependent since most other hand positions either cannot operate the latch release or do so uncomfortably, so that operation of the latch in most cases is dependent upon the position of the operator's left hand. Thus, if the hand 88 is in the wrong position, the location of the latch release on the knife sharpener 25 prevents the hand from ordinarily actuating the latch release until the hand assumes the preferred position with respect to the sharpener wherein the fingers thereof are remote from the slicing machine knife 15.

As may be seen, therefore, the present invention provides numerous advantages. To move the sharpener between the storage and sharpener position, the operator simply grasps the cover 70 with his left hand 88, as shown in FIG. 2, and lifts the sharpener up and over to the desired position. The channels and pins 52–55 provide an easy, single action movement for moving the sharpener. To return to the storage position, the operator again simply grasps the cover 70 with his left hand 88 and presses on the latch release 95 with his finger 98 to release the latch so that the sharpener may be lifted up and over to the storage position.

One of the most important advantages is the protection of the knife edge 20 at all times in the sharpening region adjacent cutout 28, as long as sharpener 25 is mounted on slicing machine 10. Further, due to latch 90, the hand which grasps the sharpener housing will normally be protected by the guard cover 70 as the sharpener is moved from the sharpening to the storage position. This invention therefore provides substantially improved safety over many prior art configurations.

Cleaning and servicing are facilitated by buttons 57 which enable pins 55 to be retracted easily from channels 52 so that sharpener 25 may be quickly released from machine 10.

Honing stone 31 is pivoted so that it automatically seeks the proper honing angle for the knife. The stones are also protected from commodity residues in the storage position, for improved sanitation.

While the form of apparatus herein described constitutes a preferred embodiment of this invention, it is to be understood that the invention is not limited to this precise form of apparatus, and that changes may be made therein without departing from the scope of the invention.

What is claimed is:

1. In a commodity slicing machine, including a rotatable circular knife having a cutting edge; means for rotating the knife; knife sharpening means including dressing members engageable with the knife at the cutting edge for sharpening the edge; a guard cover for the dressing members, the guard cover including a handhold; guard means cooperating with the knife to expose a first part of the knife cutting edge in an active cutting area, to selectively expose a second part of the knife cutting edge in a sharpening area for sharpening, and to surround and protect the remaining parts of the knife cutting edge in an inactive area; and guide means mounting the knife sharpening means adjacent the sharpening area for one-hand gripping and movement between a sharpening position placing the dressing members adjacent the knife edge and a retracted storage position removed from the knife edge, the improvement comprising:

a. releasable latch means for holding the knife sharpening means in a predetermined position, b. a position-dependent latch release for releasing said latch means for movement of the sharpening means from said predetermined position, and c. means locating said latch release on the knife sharpening means for preventing a human hand from ordinarily actuating said latch release unless that hand assumes a predetermined position with respect to the handhold wherein the fingers of said hand are remote from the edge of the slicing machine knife.

2. The device of claim 1 wherein the dressing members are located on one side of the knife sharpening means and wherein said latch release is located substantially on the opposite side of the knife sharpening means from the dressing members.

3. The device of claim 1 wherein said latch means further comprises a latch member having a hook, a spring for biasing the hook in a first direction, a guide on which said latch member is mounted for movement in said first direction in response to said spring, and a latch release portion on said latch means for moving said latch member in a direction opposite to said first direction when pressure is applied to said latch release to overcome the bias of said spring.

4. In a commodity slicing machine, including a rotatable circular knife having a cutting edge; means for rotating the knife; knife sharpening means including dressing members located on one side of the knife sharpening means and being engageable with the knife at the cutting edge for sharpening the edge; a guard cover for the dressing members, the guard cover including a handhold; guard means cooperating with the knife to expose a first part of the knife cutting edge in an active cutting area, to selectively expose a second part of the knife cutting edge in a sharpening area for sharpening, and to surround and protect the remaining parts of the knife cutting edge in an inactive area; and guide means mounting the knife sharpening means adjacent the sharpening area for one-hand gripping and movement between a sharpening position placing the dressing members adjacent the knife edge and a retracted storage position removed from the knife edge, the improvement comprising:

a. releasable latch means for holding the knife sharpening means in a predetermined position, b. said latch means including a latch member having a hook on one end, ana integral spring arm for biasing the hook in a first direction, a pivot on which said latch member is mounted for rotation in said first direction in response to said spring arm, and a position-dependent latch release for releasing said latch means for movement of the sharpening means from said predetermined position, said latch release being on said latch means for rotating said latch member about said pivot in a direction opposite to said first direction when pressure is applied to said latch release to overcome the bias of said spring arm, and c. means locating said latch release substantially on the opposite side of the knife sharpening means from the dressing members for preventing a human hand from ordinarily actuating said latch release unless that hand assumes a predetermined position with respect to the handhold wherein the fingers of said hand are remote from the edge of the slicing machine knife.

5. In a commodity slicing machine, including a rotatable circular knife having a cutting edge; means for rotating the knife; knife sharpening means including dressing members engageable with the knife at the cutting edge for sharpening the edge; means for supporting the dressing members on the knife sharpening means; guard means cooperating with the knife to expose a first part of the knife cutting edge in an active cutting area, to selectively expose a second part of the knife cutting edge in a sharpening area for sharpening, and to surround and protect the remaining parts of the knife cutting edge in an inactive area; guide means mounting the knife sharpening means adjacent the sharpening area for one-hand gripping and movement between a sharpening position placing the dressing members adjacent the knife edge and a retracted storage position removed from the knife edge; and a guard cover for the knife sharpening means and the exposed knife cutting edge thereadjacent, the cover including a handhold and having a guarding section which includes a first portion on one side of the dressing member supporting means substantially straddling the cutting edge in the sharpening position, and a second portion located adjacent the first portion on the same side of the dressing member supporting means and substantially straddling the cutting edge in the storage position, the improvement comprising:

a. releasable latch means for holding the knife sharpening means in a predetermined position, b. a position-dependent latch release for releasing said latch for movement of the sharpening means from said predetermined position, and c. means locating said latch release on the opposite side of the dressing member supporting means from the first and second guarding section portions and for preventing a human hand from ordinarily actuating said latch unless the hand assumes a predetermined position with respect to the handhold wherein the fingers of said hand are remote from the edge of the slicing machine knife.

* * * * *